US008627999B2

(12) United States Patent
Wolf et al.

(10) Patent No.: US 8,627,999 B2
(45) Date of Patent: Jan. 14, 2014

(54) BEVERAGE CONTAINER

(75) Inventors: Kurt M. Wolf, Chicago, IL (US); Matthew R. Cook, Hinsdale, IL (US); Thomas Fu, Naperville, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 171 days.

(21) Appl. No.: 13/209,030

(22) Filed: Aug. 12, 2011

(65) Prior Publication Data

US 2012/0037635 A1 Feb. 16, 2012

Related U.S. Application Data

(60) Provisional application No. 61/373,595, filed on Aug. 13, 2010.

(51) Int. Cl.
*B65D 5/74* (2006.01)

(52) U.S. Cl.
USPC ..... 229/117.3; 229/117.35; 229/117.15; 229/125.04

(58) Field of Classification Search
USPC ..... 229/117.3, 117.35, 117.15, 125.14, 229/125.15, 125.04
See application file for complete search history.

(56) References Cited

U.S. PATENT DOCUMENTS

| | | | |
|---|---|---|---|
| 2,714,982 | A | 8/1955 | Strauss |
| 3,087,655 | A | 4/1963 | Scholle |
| 4,815,631 | A | 3/1989 | Eeg et al. |
| 5,074,429 | A | 12/1991 | Konkel |
| 5,092,486 | A | 3/1992 | vom Hofe |
| 5,147,062 | A | 9/1992 | Heuberger |
| 5,201,462 | A | 4/1993 | Sada |
| 5,263,339 | A | 11/1993 | Evans |
| 5,265,753 | A | 11/1993 | Moorman |
| 5,715,992 | A | 2/1998 | Andrews |
| 5,769,028 | A | 6/1998 | Deckys |
| 5,909,841 | A | 6/1999 | Andrews |
| 5,950,831 | A | 9/1999 | Millet |
| 6,053,401 | A | 4/2000 | Andrews, Sr. |
| 6,062,431 | A | 5/2000 | Geshay |
| 6,182,887 | B1 | 2/2001 | Ljunstrom |

(Continued)

FOREIGN PATENT DOCUMENTS

| | | | |
|---|---|---|---|
| AU | 493047 | B2 | 5/1978 |
| GB | 1161713 | A | 8/1969 |

OTHER PUBLICATIONS

International Search Report and Written Opinion for PCT/US2011/047405, mailed Nov. 14, 2011.

*Primary Examiner* — Nathan J Newhouse
*Assistant Examiner* — Scott McNurlen
(74) *Attorney, Agent, or Firm* — Brinks Gilson & Lione

(57) ABSTRACT

A beverage container includes right, left, front, and rear sidewalls that define a closed space there between. The right sidewall defines an opening. The beverage container also includes a bag for storing fluids that is positioned within the closed space. The bag includes a spout for dispensing the fluids. At least a portion of the spout extends through the opening in the right sidewall. The beverage container includes first and second lid members that extend from respective top edges of the front sidewall and the rear sidewall, respectively. The first and second lid members cover the bag when in a closed configuration. In the closed configuration, a side edge of at least one of the lid members is positioned behind at least a portion of the spout and is configured to prevent the spout from falling into the closed space.

15 Claims, 4 Drawing Sheets

(56) References Cited

U.S. PATENT DOCUMENTS

| | | | | |
|---|---|---|---|---|
| 6,196,452 | B1 | 3/2001 | Andrews, Sr. | |
| 6,209,781 | B1 | 4/2001 | Sylvester | |
| 6,223,981 | B1 | 5/2001 | Gunder | |
| 6,253,993 | B1 * | 7/2001 | Lloyd et al. | 229/117.3 |
| 6,290,124 | B2 | 9/2001 | Andrews | |
| RE38,377 | E | 1/2004 | Geshay | |
| 7,077,309 | B2 | 7/2006 | Andrews, Sr. | |
| 7,571,835 | B2 | 8/2009 | Hill | |
| 7,681,783 | B2 | 3/2010 | Stephenson | |
| D617,635 | S * | 6/2010 | Gould | D9/431 |
| 2002/0047040 | A1 | 4/2002 | Andrews | |
| 2005/0211754 | A1 | 9/2005 | Fulcher | |
| 2006/0202005 | A1 | 9/2006 | Andrews | |
| 2006/0243783 | A1 | 11/2006 | Spivey | |
| 2010/0127057 | A1 | 5/2010 | Burke | |

* cited by examiner

BEVERAGE CONTAINER

RELATED APPLICATIONS

This patent application claims the benefit of the filing date under 35 U.S.C. §119(e) of Provisional U.S. Patent Application Ser. No. 61/373,595, filed Aug. 13, 2010, the contents of which are hereby incorporated by reference in their entirety.

BACKGROUND

Beverage containers are utilized to store and dispense liquids, such as coffee. For example, a coffee shop may pour several cups of coffee into a beverage container that can then be dispensed at the office.

Typical beverage containers are made from a single piece of cardboard that is folded to form the container. A liquid-tight bag for storing liquid is placed in the interior of the container. The bag may include a spout that protrudes through an opening of the container. The bag may be filled via the spout and the liquid later dispensed via the spout.

As liquid is dispensed, there is a chance that the spout may fall into the container. To overcome this problem, a ring for preventing the spout from falling into the container may be placed over the spout after the spout is pulled through the opening. However, the ring is a separate piece of material. As such, it may become lost, rendering the container useless. Moreover, the ring may be formed of the same sheet of material from which the container is formed necessitating additional material and further processing steps for removing the ring.

BRIEF SUMMARY

A beverage container includes right, left, front, and rear sidewalls that define a closed space there between. The right sidewall defines an opening. The beverage container also includes a bag for storing fluids and is positioned within the closed space. The bag includes a spout for dispensing the fluids. At least a portion of the spout extends through the opening in the right sidewall. The beverage container also includes first and second lid members that extend from respective top edges of the front sidewall and the rear sidewall, respectively. The first and second lid members cover the bag when in a closed configuration. In the closed configuration, a side edge of at least one of the lid members is positioned behind at least a portion of the spout and is configured to prevent the spout from falling into the closed space.

Other features and advantages will be, or will become, apparent to one with skill in the art upon examination of the following figures and detailed description. It is intended that all such additional features and advantages included within this description, be within the scope of the invention, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

The exemplary embodiments below describe a beverage container for storing and dispensing liquids. Generally, the beverage container includes right, left, front, and rear side walls that define a space for placement of a beverage bag that includes a spout. The spout extends through an opening of the right sidewall. The beverage container includes a pair of lid members that are configured to cover the bag in a closed configuration. In the closed configuration, a portion of the lid members is positioned in a region that is behind the spout to prevent the spout from falling into the interior of the container.

Figure 1:
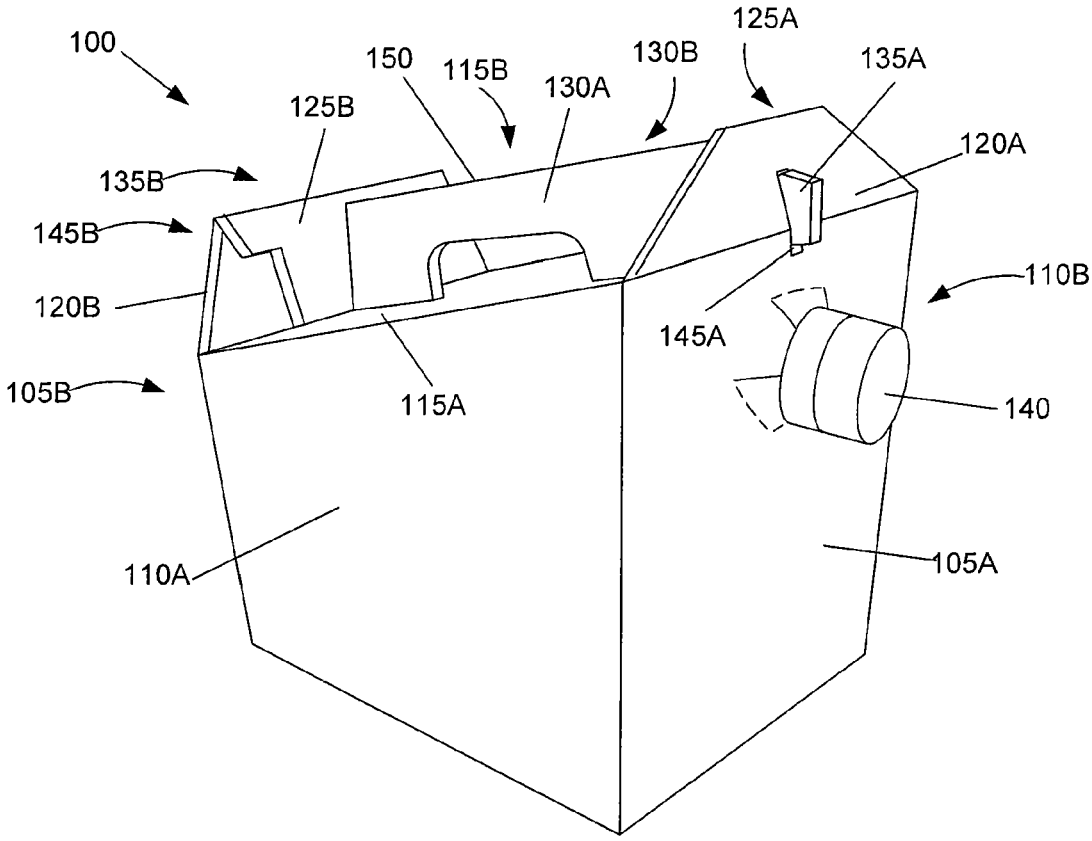
FIG. 1 illustrates a perspective view of a beverage container.

FIG. 1 illustrates a perspective view of a beverage container 100, herein after referred to as the container 100. The container 100 includes a right sidewall 105A, a left sidewall 105B, a front sidewall 110A and a rear sidewall 110B. The respective sidewalls are joined at respective edges to form a closed space there between for placement of a beverage bag 205 (FIG. 2A), hereinafter referred to as the bag 205. The right sidewall 105A defines an opening 305 (FIG. 3) through which a portion of a spout 140 of the bag 205 extends.

The container also includes a first lid member 115A and a second lid member 115B that extend from a top edge of the front sidewall 110A and the rear sidewall 110B, respectively. The first lid member 115A and the second lid member 115B can be in placed in both open and closed configurations. The open configuration enables placement of the bag 205 within the container 100. The closed configuration secures the bag 205 in the container.

In the closed configuration, the first lid member 115A and second lid member 115B define first and second handle members 130A and 130B, respectively, that come together to form a handle 150 that enables carrying the container 100. The handle 150 includes first and second tabs 135A and 135B configured to enter first and second slots 145A and 145B defined by the right sidewall 105A and the left sidewall 105B, respectively. The respective tabs 135A and 135B cooperate with the slots 145A and 145B to secure the first and second handle members 130A and 135B together in the closed configuration.

The right sidewall 105A and the left sidewall 105B each define respective flap members 125A and 125B that extend from a top edge of the right sidewall 105A and the left sidewall 105B, respectively. The flap members 125A and 125B are configured to be folded in an inward direction behind the right and left side walls 105A and 105B, respectively. Each flap member 125A and 125B defines a slot 315A (FIG. 3) and 315B (FIG. 3) through which a respective tab of the handle 150 extends. The slots 315A and 315B of the flap members 125A and 125B cooperate the with the slots 145A and 145B of the right and left sidewalls 105A and 105B to strengthen the connection between the handle 150 and the sidewalls, enabling increased carrying capacity of the container 100.

Figure 2A:
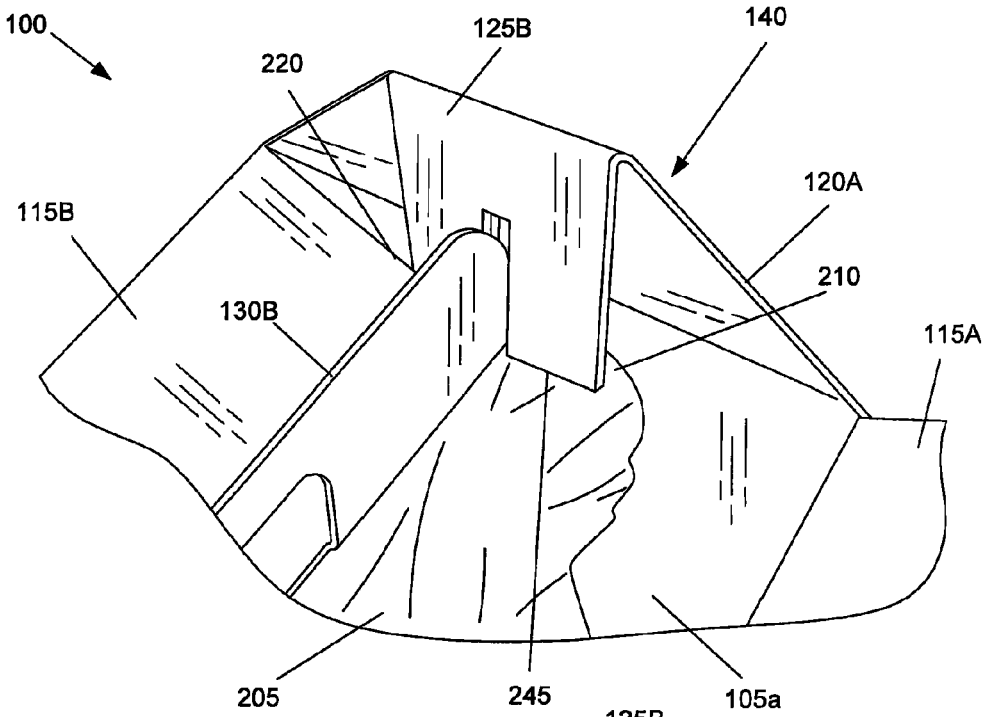
FIGS. 2A and 2B are perspective and cross-sectional views of an interior region of the container near a spout of the container.
Figure 2B:
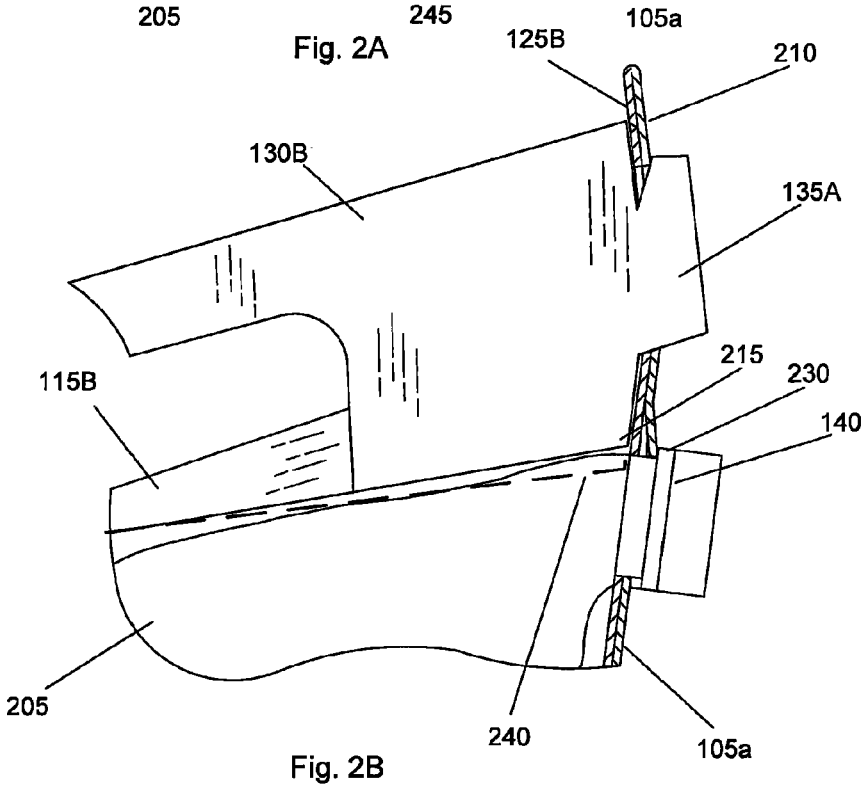

FIGS. 2A and 2B are perspective and cross-sectional views, respectively, of an interior region of the container 100 near the spout 140, and illustrate the relationship between the second lid member 115B and the spout 140. The first lid member 115A is illustrated in an open configuration, but may be similarly positioned relative to the spout 140 when in the closed configuration.

In the closed configuration, the right edge 220 of the second lid member 115B is arranged so that a corner 215 (FIG. 2B) of the right edge 220 is positioned substantially behind at least a portion of the spout 140. In some implementations, the spout 140 may include a raised ridge 230. The raised ridge 230 may be sized to interfere with the corner 214 so that the spout 145 cannot fall back into the interior of the container 100. In other words, the corner 215 of second lid member 115B cooperates with the raised ridge 230 to secure the spout 140 in the opening 305.

In alternative embodiments, the corner 215 of the right edge 220 may be positioned to interfere with an interior portion of the spout 140, as illustrated by the dashed line 240 in FIG. 2B. In yet other embodiments, the flap member 125B is sized so that a lower edge 245 of the flap member 125B prevents the spout 140 from falling into the interior of the container 100.

Figure 3:
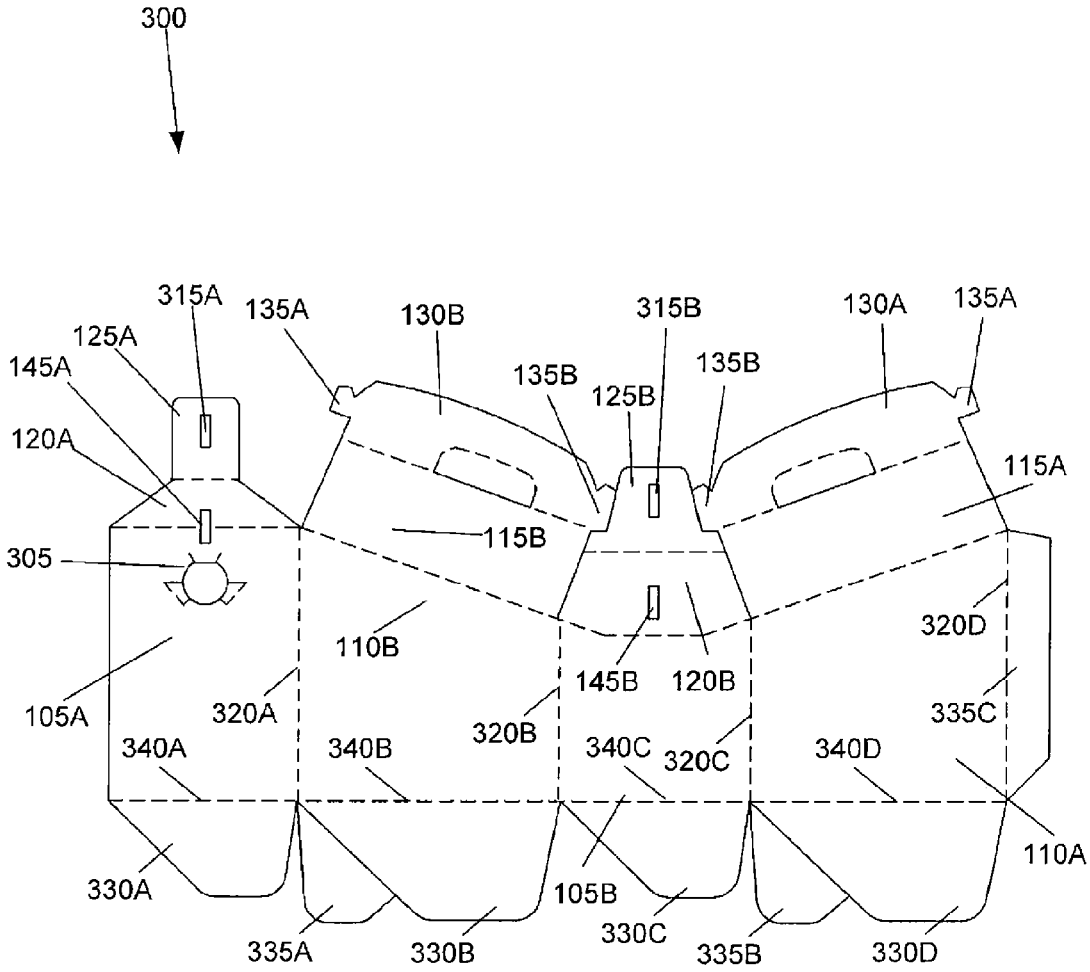
FIG. 3 illustrates a plan view of a sheet of material from which the beverage container of FIG. 1 is assembled.
Figure 4:
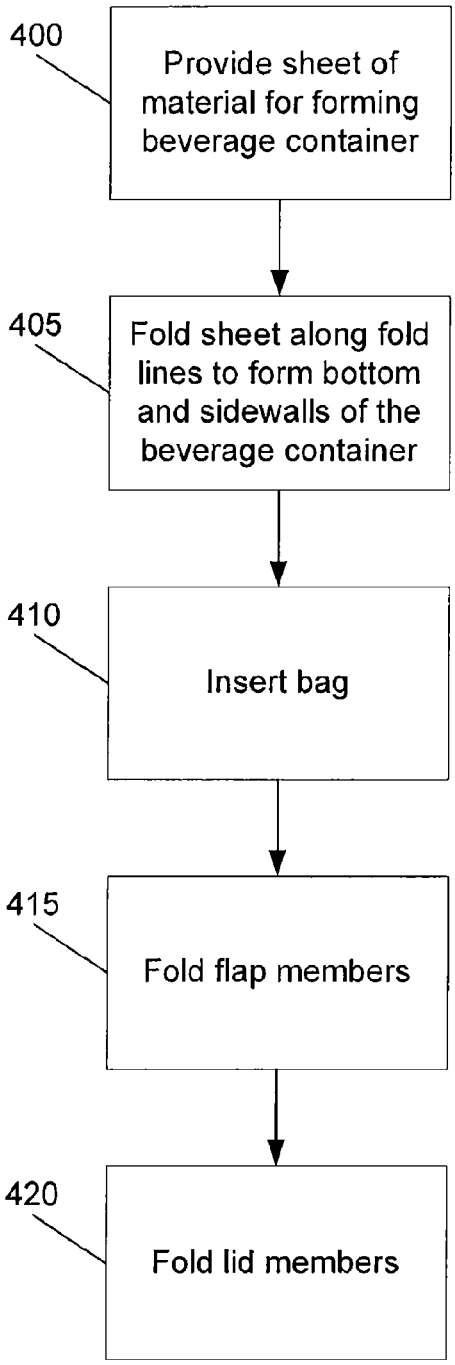
FIG. 4 illustrates operations for forming the sheet of material 300 into the beverage container of FIG. 1.

FIG. 3 illustrates a plan view of sheet of material 300 (herein after sheet) from which the container 100 is assembled. The sheet 300 may correspond to a corrugated paper material or a different material. Dashed lines correspond to fold lines and solid lines are cuts. FIG. 4 illustrates operations for forming the sheet of material 300 into the beverage container of FIG. 1.

At block 400, a sheet of material 300 from which the beverage container is form is provided.

At block 405, the sheet 300 is folded along various fold lines to form the bottom and sidewalls of the beverage container. For example, the sheet 300 is folded about vertical fold lines 320A-D that define the right, left, front, and back sidewalls 105A, 105B, 110A, and 110B of the container 100. Lower flaps 330A-D that define the bottom of the container 100 are then folded toward an interior region of the container 100. Next, glue flaps 335A-C are adhered to respective opposing inner portions of the container 100 to maintain the container 100 in an assembled configuration. The glue flaps 335A-C may include an adhesive that bonds to the material 300.

At block 410, a bag 305 is positioned within the space defined by the respective sidewalls 105A, 105B, 110A, 110B. The spout 140 of the bag 205 is then pushed through the opening 305 in the right sidewall 105A.

At block 415, the flap members 125A and 125B that extend from the top edge of the right sidewall 105A and the left sidewall 105B, respectively, are folded, so that the slots 315A and 315B of the flap members 125A and 125B are substantially in line with respective slots 145A and 145B defined by the right sidewall 120A and the left sidewall 120B, respectively.

At block 420, the first lid member 115A and second lid member 115B are folded to cover the bag 205 and form the handle of the container 100. During this operation, the corners 215 of the first and second lid member 115A and 115B are positioned behind the spout to prevent the spout 140 from falling into the container 100. The tabs 135A and 135B of the handle 150 are then inserted into respective slots 145A, 145B, 315A, and 315B to secure the handle 150 in place.

While various embodiments of the invention have been described, it will be apparent to those of ordinary skill in the art that many more embodiments and implementations are possible that are within the scope of the invention. For example, the container may include more than four sides. The container may not define a handle. The container may be made from various materials suitable for manufacturing containers. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A beverage container comprising:

right, left, front, and rear sidewalls that define a closed space there between, wherein the right sidewall defines an opening;

a bag for storing fluids positioned in the closed space, wherein the bag includes a spout for dispensing the fluids, at least a portion of the spout extends through the opening;

first and second planar lid members that extend from a top edge of the front sidewall and the rear sidewall, respectively, that cover the bag in a closed configuration, wherein in the closed configuration a portion of a side edge that abuts the right sidewall of at least one of the first and second lid members is positioned below a top edge of the right sidewall and behind at least a portion of the spout and is configured to prevent the spout from falling into the closed space.

2. The beverage container according to claim 1, wherein the first and second lid members define handle members.

3. The beverage container according to claim 2, wherein the handle members define first and second tabs on opposite ends configured to enter respective slots defined on the right and left sidewalls, respectively.

4. The beverage container according to claim 3, wherein the right and left sidewalls define respective flap members that extend from respective top edges and that are configured to be folded in an inward direction behind the right and left sidewalls, respectively, wherein the flap members each define a slot through which a respective tab of the first and second tabs extends, and wherein the flap member of the right sidewall presses against an outside surface of the at least one of the first and second lid members to maintain the side edge behind the portion of the spout.

5. The beverage container according to claim 1, wherein the container comprises a corrugated material.

6. A method for assembling a beverage container comprising:

providing a container that includes right, left, front, and rear sidewalls that define a closed space there between, wherein the right sidewall defines an opening;

inserting a bag for storing fluids that includes a spout in the closed space, so that at least a portion of the spout extends through the opening; and covering the bag with first and second planar lid members of the container that extend from a top edge of the front sidewall and the rear sidewall, respectively, so that a portion of a side edge that abuts the right sidewall of at least one of the first and second lid members is positioned below a top edge of the right sidewall and behind at least a portion of the spout so as to prevent the spout from falling into the closed space.

7. The method according to claim 6, wherein the first and second lid members define handle members.

8. The method according to claim 7, wherein the handle members define first and second tabs on opposite ends configured to enter respective slots defined on the right and left sidewalls, respectively.

9. The method according to claim 8, wherein the right and left sidewalls define respective flap members that extend from respective top edges and that are configured to be folded in an inward direction behind the right and left side members, respectively, wherein the flap members each define a slot through which a respective tab of the first and second tabs extends, and wherein the flap member of the right sidewall presses against an outside surface of the at least one of the first and second lid members to maintain the side edge behind the portion of the spout.

10. The method according to claim 6, wherein the container comprises a corrugated material.

11. A method for manufacturing a beverage container comprising:

providing a sheet of material;

forming, on the sheet of material, fold lines that define right, left, front, and rear sidewalls;

forming an opening on the right sidewall;

forming first and second planar lid members that extend from a top edge of the front sidewall and the rear sidewall, respectively, wherein in an assembled configuration, the first and second lid members cover a bag, and wherein in the assembled configuration a portion of a side edge that abuts the right sidewall of at least one of the first and second lid members is positioned below a top edge of the right sidewall and behind at least a portion of a spout of the bag and is configured to prevent the spout from falling into the closed space.

12. The method according to claim 11, wherein the first and second lid members define handle members.

13. The method according to claim 12, wherein the handle members define first and second tabs on opposite ends configured to enter respective slots defined on the right and left sidewalls, respectively.

14. The method according to claim 13, wherein the right and left sidewalls define respective flap members that extend from respective top edges and that are configured to be folded in an inward direction behind the right and left side members, respectively, wherein the flap members each define a slot through which a respective tab of the first and second tabs extends, and wherein the flap member of the right sidewall presses against an outside surface of the at least one of the first and second lid members to maintain the side edge behind the portion of the spout.

15. The method according to claim 11, wherein the container comprises a corrugated material.

* * * * *